United States Patent [19]

Zimmer

[11] Patent Number: 4,777,873

[45] Date of Patent: Oct. 18, 1988

[54] VERTICAL BALER WITH CABLE-TYPE BALE EJECTOR

[76] Inventor: John Zimmer, 6029 Louis St., P.O. Box 2235, New Iberia, La. 70561-2235

[21] Appl. No.: 8,478

[22] Filed: Jan. 29, 1987

[51] Int. Cl.[4] ..... B30B 9/30; B30B 15/06

[52] U.S. Cl. ..... 100/218; 100/53; 100/245; 100/255; 100/295

[58] Field of Search ..... 100/218, 53, 255, 295

[56] References Cited

U.S. PATENT DOCUMENTS

| | | | |
|---|---|---|---|
| 1,040,396 | 10/1912 | Paal | 100/218 |
| 3,885,466 | 5/1975 | Cerniglia | 100/218 |
| 3,916,781 | 11/1975 | Cerniglia | 100/218 X |
| 4,182,236 | 1/1980 | Greer | 100/218 X |
| 4,232,599 | 11/1980 | Ulrich | 100/218 X |

*Primary Examiner*—Andrew M. Falik

*Attorney, Agent, or Firm*—Pravel, Gambrell, Hewitt Kimball & Krieger

[57] ABSTRACT

A vertical baler comprises a piston having two brackets attached to the rear thereof, the brackets extending through slots between panels in the rear wall of the baler. Chains are attached to the floor of the baler near the front thereof, pass through the slots in the rear wall of the baler, and are attached to a horizontal bar. The bar has two legs extending downwardly therefrom, the legs having slots in the ends thereof. The rear wall of the baler has a pair of dog members pivotally attached thereto. When it is desired to remove a bale from the baler, the door of the baler is opened, the horizontal bar is manually placed onto the brackets extending from the rear of the piston, and the piston is raised. As the piston raises, it lifts up the chains and throws the bale out of the baler. The dog members present no resistance to the upward movement of the horizontal member, since they pivot upwardly out of the way of the horizontal member. As the piston goes down, the slots in the legs attached to the horizontal bar engage the dog members causing the horizontal bar to move downwardly and outwardly of the rear wall. Continued downward motion of the piston causes the brackets of the piston to become disengaged from the horozontal bar member. When the piston again rises, the brackets on the piston do not contact the bar member, thus leaving the chains in a relaxed position until it is again desired to eject a bale from the baler.

7 Claims, 1 Drawing Sheet

VERTICAL BALER WITH CABLE-TYPE BALE EJECTOR

BACKGROUND OF THE INVENTION

1. Field of the Invention

The apparatus of the present invention relates to vertical balers. More particularly, the present invention relates to an improvement in a vertical baler which would include means for assuring that the baler injection components are rendered inoperable during the baling process.

2. General Background

It is common, in the art of baling, to provide a vertical type baler for scrap material wherein there is generally provided a rectangular compacting chamber defined between parallel spaced vertical walls mounted on a base and a rear wall which is formed by a series of parallel spaced channel members which define vertical slots between them. Access to the compacting chamber for depositing scraps of material therein is usually through the use of a slidably movable window, and access to the baled material is obtained through a hinged door on the bottom portion of the baling chamber. Therefore, upon closing of the lower door, and waste being deposited therein, an upper ram is moved downward under force through the baling chamber and compacts scrap material between itself and the floor until a particularly sized bale is achieved.

In order to remove the bale, there are provided usually at least two flexible bale ejecting members, cables or chains which are connected to the front portion of the floor of the baling chamber and are extended through the chamber to a member, exterior to the rear wall of the chamber, which cannot be placed in position while baling is taking place. However, once a bale has been formed, the rear member is then situated on lugs contained on the rear wall of the ram and, as the ram moves upward, the chain is extended substantially diagonally through the baling chamber and once the door is opened the bale is literally rolled out of the baling chamber through the diagonal extension of the ejecting chains.

Although this is a standard method of removing bales within the baling chamber, it does have significant shortcomings. One of the shortcomings is the fact that after the rear member has been attached to the ram, one must manually, in the present state of the art, remove the member from the ram, so that as the ram goes through the baling process the chains are not extended upward until such time as the bale has been formed. If the chain is not manually removed, what occurs at this point is that after the door and the window to the baler have been closed and the baling process takes place, as the ram moves upward, the chain is naturally extended diagonally through the baling chamber. This can occur for a certain amount of time after which if a certain quantity of scrap material has been placed in the chamber, the force of the chains against the scrap material will literally break the door open which could, of course in addition to damaging the baler itself, cause injury to any person who may be standing near the baler as this takes place.

Although no patents have been discovered which would cover the present invention for alleviating this problem, the following patents were cited as pertinent to the vertical baler art:

| PATENT NO | DATE PATENTED: | TITLE: |
|---|---|---|
| 4,182,236 | 01/08/80 | "Vertical Baler With Improved Material Hold-Down And Bale Ejecting Means" |
| 4,232,599 | 11/11/80 | "Waste Paper Compacter With Front Access Features" |
| 4,363,267 | 12/14/86 | "Vertical Baler With Improved Safety Gate And Door Latch System" |
| 4,002,115 | 01/11/77 | "Double Baling Press" |
| 3,916,781 | 11/04/75 | "Bale Ejection System" |
| 3,851,577 | 12/03/74 | "Vertical Baler" |
| 3,677,175 | 07/18/72 | "Bale Ejector" |
| 3,195,447 | 07/20/65 | "Portable Apparatus For Baling Trash" |
| 2,590,649 | 03/25/52 | "Bale Ejector" |
| 2,136,147 | 11/08/38 | "Locking Device" |
| 1,856,531 | 05/03/32 | "Latch For Baling Press Doors" |
| 4,436,029 | 03/13/84 | "Device For The Press Door Of A Baling Press" |

SUMMARY OF THE PRESENT INVENTION

The apparatus of the present invention solves the shortcomings in the art in a simple and straightforward manner. In a vertical baler for scrap material, which would generally include a rectangular compacting chamber defined by parallel spaced vertical end walls mounted on a base forming a bottom portion and a rear wall formed by series of parallel spaced channel members which define vertical slots therebetween, the front of the baler having a hinged door for forming the front wall of the compacting chamber, and a horizontal rectangular piston suspended within the chamber by a ram of the vertical hydraulic cylinder so that any scrap material within the baler is compacted between the closed wall portions of the baler of the floor portion and the horizontal piston. In such a baler there is further included a bale ejecting means which would include a pair of chains, cables or other line members or ejection lines connectedly engaged at the front wall of the floor portion, and extending through a pair of vertical slots in the rear wall of the baler. Each of the chain portions are connected to the end of a horizontal member and in the non-operative position allows the chains to be extended along the floor of the baler. In the operative position, the horizontal member positioned on a bracket on the rear portion of the piston extends through the vertical slots, so that as the piston is raised within the baling chamber, the chains likewise are extended from their first position on the floor of the chamber to the second position in full extension between the front floor of the chamber to the rear upper portion of the baling chamber, in effect, bisecting the space within the chamber.

The improvement would include a pair of downwardly depending legs on either side of the horizontal member, each pair of legs having a vertical slot at their foot portion for serving as an engaging means. Further, there is included disengaging means comprising a pair of hinged dog members which are freely rotatable upwardly, but in their downwardmost position lie horizontally for engaging the slot within the downwardly depending leg members. Therefore, as the horizontal member moves upward past the dogs, the dogs are moved upwardly to allow the member to pass; however, as the piston moves down, the slots of leg members then engage the dogs, which then acts as stop means, and the horizontal member with the chain attached thereto can travel no further downward, and therefore the disengaging of the piston from the member allows the member to rest upon the dogs, in such a position that when the piston is returned to the "up" position, the piston will not reengage the horizontal member. Thus the chains will be maintained in their first position along the floor of the chamber until the horizontal member is manually positioned onto the brackets of the piston when it is desired to eject a bale from the baler.

Therefore, it is the principal object of the present invention to provide an improvement in the vertical baler which eliminates the problem of inadvertently ejecting scrap from the baler during the baling process.

It is further a principal object of the present invention to provide a modified ejection means on the baler which assures that the ejection means will be inoperative as the baling process is taking place.

DETAILED DESCRIPTION OF THE PREFERRED EMBODIMENT

Figure 1:
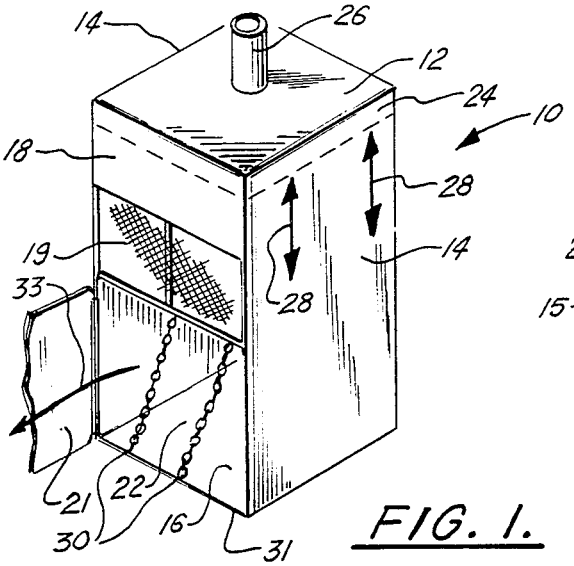
FIG. 1 is an overall view of a vertical baler of the present invention.

FIGS. 1–6 illustrate the preferred embodiment of the apparatus of the present invention, with FIG. 1 representing an overall view of a typical vertical baler that the present invention operates in conjunction with.

Figure 2:
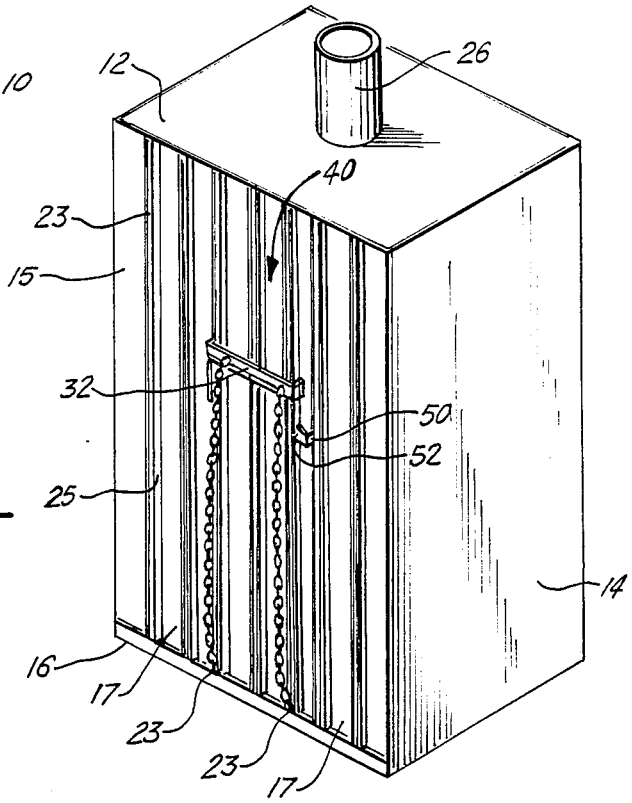
FIG. 2 is an overall view illustrating the rear wall of the vertical baler of the present invention.

As seen in FIGS. 1 and 2, vertical baler 10 would comprise a top portion 12, vertical side wall portions 14, and a floor portion 16. There would be further included a front partial wall portion 18 with the entire front wall defined by partial wall portion 18, slidable gate member 19 in its mid portion and a lower hinged gate portion 21 hingedly attached to the left vertical wall portion 14. FIG. 2 shows the back wall portion 15. The wall portions 14, 15, and 18, floor portion 161 top portion 12, slideable gate member 19, and lower hinged gate portion 21 define a compacting chamber 22 therewithin for compacting scraps of material which would normally be deposited through gate member 19 during the process. In operation, vertical baler 10 would include a horizontally disposed rectangular piston member 24 suspended within the chamber 22 from a ram or piston rod 26 which would normally be hydraulically controlled. Therefore, rectangular piston member 24 could move upward and downward within baling chamber 22 as seen by Arrows 28. Of course, in the baling process, both gate member 19 and hinged door member 21 would be placed in the closed position for defining the confined baling chamber 22 therewithin.

As is illustrated in FIG. 2, a view of rear wall portion 15 is illustrated at this time for purposes of structure. Rear wall 15 would include a plurality of metal panels 17 spaced so that there are included vertical spaces 23 therebetween, with vertical spaces 23 running from the top portion 12 to the floor portion 16 of the chamber 22. Each metal panel 17 would be bounded on either side by a pair of channel irons 25 for defining the plurality of channels 23 running down the rear wall 15.

Figure 3:
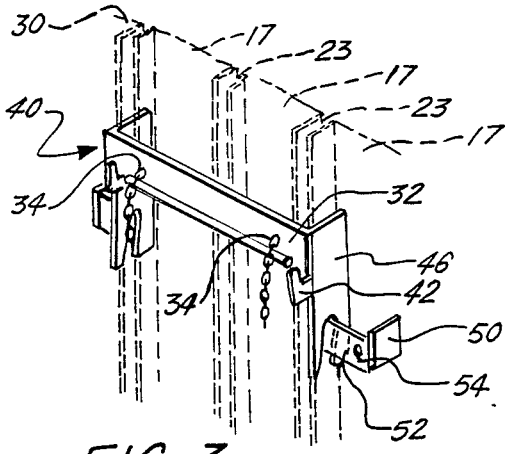
FIG. 3 is a composite view of the improvements which constitute the preferred embodiment of the present invention.

Pertinent to the present invention is the means by which the compacted bale or material, once it is tied and bound, is ejected from the baling chamber. This means would include at least a pair of flexible cables, wires or chains 30 and as seen in FIG. 1, connected at their first end portions to the front edge 31 of floor portion 16 via bolting or the like, and on their rearwardmost point extending through a pair of the vertical channels 23 as seen in FIG. 2, and connected on their second end to a horizontally disposed metal bar 32 again via bolts 34 as seen in FIG. 3. A more detailed explanation of the structure and functioning will be discussed further.

FIGS. 2–5 illustrate in detail the apparatus of the present invention by the numeral 40. As was stated earlier, apparatus 40 would comprise the standard horizontal bar or bar member 32 upon which the chains 30 are mounted, which, while the baling process is going forward, ideally bar 32 would be maintained in a stationary position allowing chains 30 to rest along the floor portion 16 of baler chamber 22. When the bale ejection mechanism is operable, bar 32 would be positioned upon a first and second bracket members 42. Bracket member 42 includes body portion 43 rigidly secured to the rear wall of piston 24 and extending to the exterior of baling chamber 22, through slots 23 in the rear wall 15. Brackets 42 would have a upper and extending lip portion 44 for providing a means for resting a bar 32 thereupon during the process for removing the bale from the apparatus. As seen particularly in FIGS. 4–6, it is known in the art that upon resting bar member 32 upon brackets 42, as piston member 24 moves to the up position, chains 30 are extended to a position as seen in FIG. 1, thereby lifting any bale contained within chamber 22 out through the door opening in the apparatus, as seen by Arrow 33.

The present invention concerns itself with a disengaging means for removing bar 32 from brackets 42 as piston member 24 continues to go through its upward and downward movement in the baling process, so that chain members 30 are not inadvertently extended when there is no need to remove a bale from the apparatus.

Figure 4:
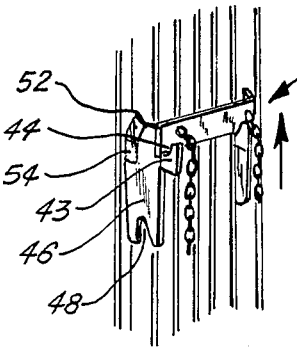
FIGS. 4, 5 and 6 represent views of the apparatus of the present invention during operation.
Figure 5:
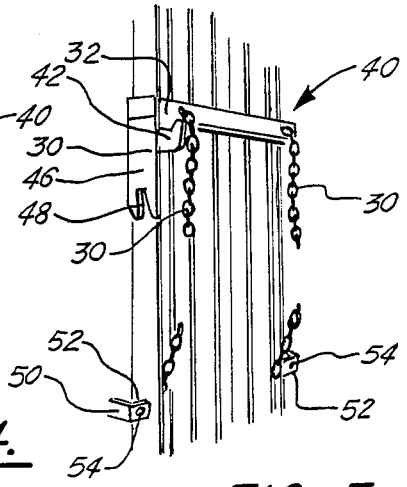
Figure 6:
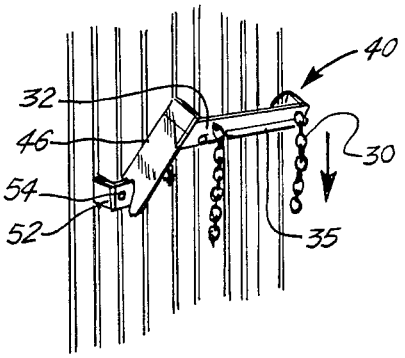

This disengaging means would include downward depending arm members 46 secured to the end portions of bar 32, arm members 46 having on their lowermost end portion a slot 48 the function of which will be described further. In addition, as seen more clearly in FIGS. 3 and 4, there is provided a stop means for engaging slots 48 as the apparatus 40 moves downward with the movement of piston 24. That stop means, includes a mounting arm 50 secured to each of a pair of the panels 17, each mounting arm 50 having a dog member 52. Dog members 52 pivot on a pin 54 (FIGS. 3–6) in the direction indicated by arrow 55 (FIG. 3) between the horizontal position shown in FIGS. 2, 3, 5, and 6 and the vertical position shown in FIG. 4. Dog members 52 are hingedly moveable to a vertical position as seen in FIG. 4 by the upward traveling of apparatus 40 from below dog members 52 to above dog members 52, therefore allowing apparatus 40 to move to the "up" position beyond dog members 52. However, upon movement of the piston 24 to the "down" position, slots 48 would engage dog members 52 as seen in FIG. 6, and due to the angulation of slot member 48, apparatus 40 would be lodged thereupon, and upon brackets 42 moving to a position below arm member 32, apparatus 40 would through gravity and the weight of chain members 30, and bar 32 would fall to the down position as seen in FIG. 6. Therefore, apparatus 40 has provided that chain members 30 become stationary and in addition, has moved to a position so that as piston 24 returns to the "up" position, brackets 42 bypass bar 32 due to the position of bar 32 as seen in FIG. 6, and therefore will not re-engage bar member 32 for raising the chains 30 to the position for extending them within chamber 22. This, therefore, would eliminate any possibility that upon traveling to the "up" position following the removal of a bale from the apparatus that the chains will continue to be serving as a bale release means.

From the illustrations in the above description, it is apparent that the baler constructed in accordance with the present invention provides a desirable feature and advantage in assuring that the ejection chains are not inadvertently maintained upon the rear of the piston 24 during the baling process. Therefore, following the manual positioning of bar 32 upon brackets 42 to eject a bale from the apparatus, the subsequent movement of the piston 24 to the "down" position will automatically enable apparatus 40 to engage dogs 52 so that the apparatus 40 is tilted rearward of rear wall 15, and therefore any further upward movement of piston 24 will assure that brackets 42 do not engage bar member 32 to re-activate the baling ejection mechanism.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A vertical baler comprising:

(a) a compacting chamber adapted to receive scrap material;

(b) a piston disposed within the chamber, the piston having a rear wall;

(c) means for moving the piston between an "up" position and a "down" position to compress the material into a bale;

(d) an ejection member adapted to be connected to the piston for ejecting a bale from the chamber in response to movement of the piston toward its "up" position, the ejection member comprising a horizontal bar engageable by brackets contained on the rear wall of the piston, the horizontal bar movable in response to movement of the piston; and (e) disengaging means cooperating with the ejection member for automatically disengaging the ejection member from the brackets, and relocating the ejection member to an outer position so that when the piston is returned to the "up" position, the ejecting member is not inadvertently re-engaged by the brackets.

2. The baler of claim 2, wherein the ejection member further comprises a pair of flexible cables interconnected between a front portion of the baler and the rear wall of the piston for providing a means to force any bale contained within the chamber of the baler out of the baler as the piston moves to the "up" position.

3. The baler of claim 1, wherein the disengaging means comprises means, contained on a rear wall of the baler, for engaging the ejection member and disallowing downward movement of the ejection member beyond a certain point, and further providing movement of the ejection member to the outer position.

4. A vertical baler including a compacting chamber adapted to receive scrap material, a piston disposed within the chamber for compacting the scrap material as the piston moves to a "down" position, and a pair of ejection lines, extending within the chamber, so that as the piston moves upward, the ejection lines are extended for thrusting any bale contained within the chamber to the exterior of the chamber, the improvement comprising:

(a) vertical bracket members secured to the rear of the piston, the bracket members positioned exterior to the chamber, and moving between "up" and "down" positions in unison with the movement of the piston;

(b) a bar attached to the pair of ejection lines;

(c) stop means secured to a rear wall of the baler for allowing the bar to move to an "up" position above the stop means, but for engaging the bar as the piston moves to a "down" position to disengage the bar from the bracket members; and (d) means for allowing the disengaged bar to move to a position away from the bracket members, so that as the piston returns to the "up" position, the bar is not reengaged by the bracket member and the ejection lines are not extended through the baling chamber.

5. The baler of claim 4, wherein upon disengagement of the bar from the bracket members the lines within the baling chamber remain in an unextended state, and thrusting of a bale out of the chamber does not occur.

6. The baler of claim 4, wherein the bar further includes a pair of downwardly depending leg members having slots engaging the stop means.

7. A vertical baler comprising:

(a) a baling chamber, defined by a front wall, a back wall, two side walls and a floor portion of the baler with a piston movable within the chamber between an "up" position and a "down" position;

(b) a door member, positioned on the front wall of the baler, for allowing release of a bale compacted within the baling chamber;

(c) a line member extending substantially from the floor portion of the baler to the rear of the piston, so that movement of the piston to the "down" position allows the line member to substantially conform to the floor of the baler, yet movement of the piston to the "up" position extends the line member diagonally across the baling chamber for thrusting any bale in the baler out of the door member of the baler;

(d) line member holding means attached to the rear portion of the piston extending outwardly exterior to the baling chamber, for carrying the line member between a first, unextended position and an extended position as the piston moves between "up" and "down" positions; and (e) a pair of stop means, secured to the rear of the baler, for engaging the line member holding means as the piston is moved to the "down" position, so that the line member is released from the piston, and the piston will travel between "up" and "down" positions while the line member is maintained in the unextended position, so that there is no inadvertent extending of the line member during the baling process.

* * * * *